US007559964B2

(12) United States Patent
Oh et al.

(10) Patent No.: US 7,559,964 B2
(45) Date of Patent: Jul. 14, 2009

(54) DUST SEPARATING APPARATUS

(75) Inventors: Jang-keun Oh, Gwangju (KR); Hak-bong Lee, Jellanam-do (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 584 days.

(21) Appl. No.: 11/318,909

(22) Filed: Dec. 27, 2005

(65) Prior Publication Data

US 2007/0012002 A1 Jan. 18, 2007

Related U.S. Application Data

(60) Provisional application No. 60/698,388, filed on Jul. 12, 2005.

(30) Foreign Application Priority Data

Aug. 9, 2005 (KR) ..... 10-2005-0072796

(51) Int. Cl.
*B01D 45/18* (2006.01)

(52) U.S. Cl. ..... 55/424; 55/428; 55/429; 55/459.1; 55/DIG. 3; 15/353

(58) Field of Classification Search ..... 55/442, 55/447, 462, 337, 345–349, DIG. 3, 428–429, 55/459.1, 456, 457, 426, 424; 15/347, 353
See application file for complete search history.

(56) References Cited

U.S. PATENT DOCUMENTS

| | | | | |
|---|---|---|---|---|
| 2002/0011052 | A1 | 1/2002 | Oh et al. | 55/424 |
| 2002/0011053 | A1* | 1/2002 | Oh | 55/426 |

FOREIGN PATENT DOCUMENTS

| | | |
|---|---|---|
| DE | 20306405 | 4/2003 |
| DE | 10356156 | 12/2004 |
| EP | 1042981 | 10/2000 |
| EP | 1297774 | 4/2003 |
| EP | 1371318 | 12/2003 |
| GB | 2358347 | 7/2001 |
| JP | 09-253011 | 9/1997 |

(Continued)

OTHER PUBLICATIONS

Office Action dated Jun. 3, 2008 corresponding to Japanese Patent Application No. 2006-008937.

(Continued)

*Primary Examiner*—Duane Smith
*Assistant Examiner*—Dung Bui
(74) *Attorney, Agent, or Firm*—Ohlandt, Greeley, Ruggiero & Perle, L.L.P.

(57) ABSTRACT

A dust separating apparatus for a vacuum cleaner having a casing, a cyclone unit formed in the casing to filter contaminants from drawn-in air and discharge air removed of the contaminants, and a dust collection part arranged in parallel with the cyclone unit in the casing to collect the contaminant separated from the air by the cyclone unit. The casing is substantially semicircular to correspond to the mounting chamber of the vacuum cleaner body. On a bottom surface of the cyclone unit, an air inlet and an air outlet are formed. The air outlet is formed at one side of the air inlet.

5 Claims, 5 Drawing Sheets

FOREIGN PATENT DOCUMENTS

| | | | |
|---|---|---|---|
| JP | 2003-153840 | | 5/2003 |
| JP | 2003-180579 | | 7/2003 |
| JP | 2004-135700 | | 5/2004 |
| JP | 2004-290340 | | 10/2004 |
| RU | 2220642 | C2 | 1/2004 |
| RU | 2228704 | C2 | 5/2004 |
| RU | 2236813 | C2 | 9/2004 |
| RU | 2255643 | C2 | 7/2005 |
| WO | WO 00/74548 | | 12/2000 |
| WO | WO 01/87131 | | 11/2001 |

OTHER PUBLICATIONS

Office Action dated Nov. 2, 2007 corresponding to Australian Patent Application No. 2006200234.

Office Action dated Apr. 27, 2007 issued from the Patent Office of the Russian Federation for corresponding Patent Application No. 2006102323/12(002512).

European Search Report dated Sep. 17, 2007 corresponding to European Patent Application No. 06290127.7.

* cited by examiner

DUST SEPARATING APPARATUS

CROSS-REFERENCE TO RELATED APPLICATIONS

This application claims the benefit under 35 U.S.C. § 119 (a) of Korean Patent Application No. 2005-72796 filed on Aug. 9, 2005, the entire content of which is incorporated herein by reference. This application also claims the benefit of U.S. Provisional Application No. 60/698,388 filed on Jul. 12, 2005, the entire content of which is also incorporated herein by reference.

BACKGROUND OF THE INVENTION

1. Field of the Invention

The present invention relates to a dust separating apparatus for a vacuum cleaner, which draws in contaminant-laden air from a cleaning surface, separates and collects contaminants from the air, and discharges clean air.

2. Description of the Related Art

There are various kinds of dust separating apparatuses. Recently, a cyclone-type dust separating apparatus has been widely used, which is convenient and can be used semi-permanently, compared to a dust separating apparatus employing a traditional disposable dust bag or dust filter. FIG. 1 is a perspective view of a canister type vacuum cleaner employing a cyclone-type dust separating apparatus.

Referring to FIG. 1, a vacuum cleaner 10 is shown, generally comprising a cleaner body 11 having a motor driving chamber 12 with a motor (not shown) and a mounting chamber 13 in which a dust separating apparatus 30 is mounted, a suction nozzle 21, an extension pipe 22, and a flexible hose 23. The vacuum cleaner 10 drives the motor (not shown) to generate a suction force, and draws contaminant-laden air from a cleaning surface through the suction nozzle 21, the extension pipe 22, and the flexible hose 23 into the cleaner body 11. The vacuum cleaner 10 uses the dust separating apparatus 30 to separate and collect dust or contaminants (hereinafter, contaminants) from drawn-in air and discharges the air removed of contaminants via the motor driving chamber 12 to the outside.

The cyclone-type dust separating apparatus 30 forms a rotative stream that separates the contaminants from the drawn-in air by centrifugal force. The cyclone-type dust separating apparatus 30 generally has a cylindrical cyclone body 31 to contain the rotative stream, an air inlet 33 and an air outlet (not shown) at an upper portion of the cyclone body 31. The air inlet 33 is fluidly communicated with flexible hose 23 via an inlet port 14, and the air outlet (not shown) is fluidly communicated with motor driving chamber 12 via an outlet port 15. A contaminant receptacle 32 for collecting the contaminant separated from the drawn-in air in the cyclone body 31 is engaged with a bottom portion of the cyclone body 31, and is also cylindrical to correspond to the cyclone body 31. In other words, the conventional dust separating apparatus 30 is generally cylindrical.

Accordingly, as shown in FIG. 2, the mounting chamber 13 includes a dead space S that is formed surrounding an area where the dust separating apparatus 30 is mounted. In the cleaner body 11, generally, the motor driving chamber 12 is substantially rectangular and the mounting chamber 13 engaged with the motor driving chamber 12 is substantially semicircular. Due to the cylindrical dust separating apparatus 30, a structural problem occurs: the creation of dead space S in the mounting chamber 13 can not be avoided. Additionally, the contaminant receptacle 32 can not be manufactured over a certain height due to the limited height of the dust separating apparatus 30 mounted in the mounting chamber 13. Because the height of the contaminant receptacle 32 is limited, the capacity of dust separation apparatus is also limited.

SUMMARY OF THE INVENTION

The present invention has been conceived to solve the above-mentioned problems occurring in the prior art, and an aspect of the present invention is to provide a dust separating apparatus which efficiently uses a dead space of a vacuum cleaner so that the capacity of the dust separating apparatus can be increased without substantially changing the design of the vacuum cleaner.

In order to achieve the above aspects, there is provided a dust separating apparatus detachably engaged with a mounting chamber of a vacuum cleaner body, comprising, a casing, a cyclone unit formed in the casing to filter a contaminant from drawn-in air and discharge air removed of the contaminant; and a dust collection part arranged in parallel with the cyclone unit in the casing to collect the contaminant separated from the air by the cyclone unit. The casing may be substantially semicircular to correspond to the mounting chamber of the vacuum cleaner body.

The cyclone unit comprises, a cyclone body forming a cyclone chamber and having a lower height than the casing, and an air inlet and an air outlet formed on a bottom surface of the cyclone body. The dust collection part may be formed on an outer circumference surface of the cyclone body to surround the cyclone body.

The cyclone body may further comprise a guide member configured on an inner wall in a spiral configuration to guide air drawn in via the air inlet to form an ascending stream in the cyclone chamber.

The apparatus may further comprise a cover detachably engaged with a top portion of the casing.

As described above, according to the dust separating apparatus consistent with embodiments of the present invention, the cyclone unit and the dust collection part are in arranged in parallel and the dust collection part is formed in a dead space surrounding the cyclone unit in the semicircular casing, thus increasing the capacity of the dust collection part when compared to the prior art. Accordingly, in the present invention, the dead space of the vacuum cleaner body, in which the dust separating apparatus is mounted, is utilized by the dust collection part, thus increasing the capacity of the dust collection part.

BRIEF DESCRIPTION OF THE DRAWINGS

The above and other aspects, features and advantages of the present invention will become more apparent and more readily appreciated from the following detailed description of the embodiment taken with reference to the accompanying drawings of which.

DETAILED DESCRIPTION OF THE INVENTION

Figure 1:
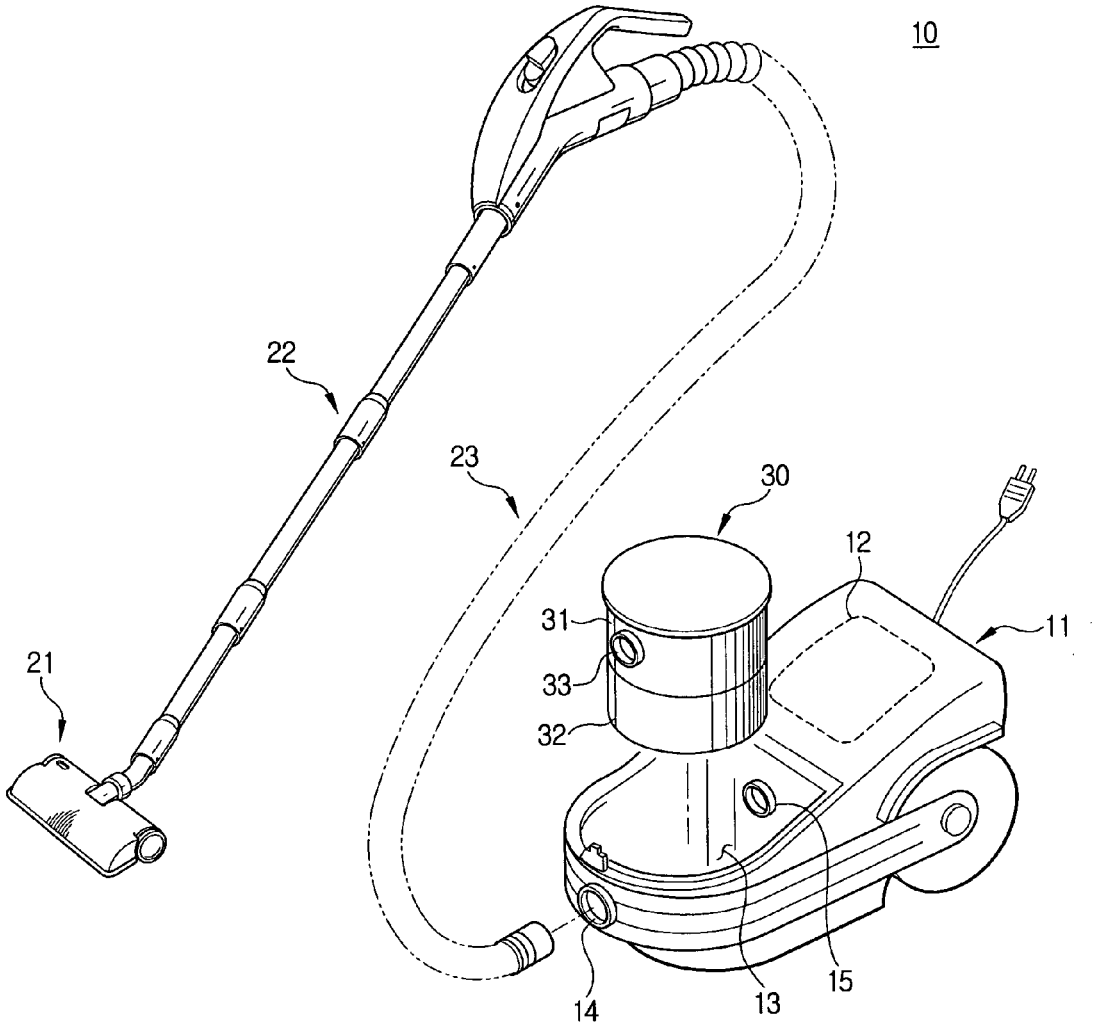
FIG. 1 (PRIOR ART)
FIG. 1 is a perspective view of a prior art vacuum cleaner employing a general dust separating apparatus.

Exemplary embodiments of the present invention will be described in detail with reference to the annexed drawings. In the drawings, the same elements are denoted by the same reference numerals throughout. In the following description, detailed descriptions of known functions and configurations incorporated herein have been omitted for conciseness and clarity.

Figure 3:
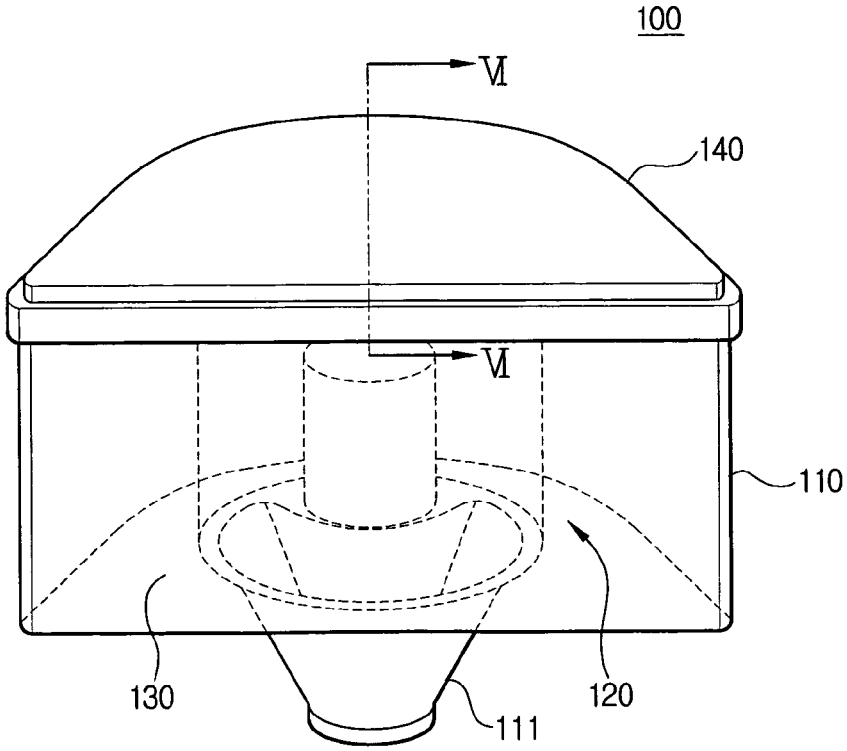
FIG. 3 is a perspective view of an external appearance of a dust separating apparatus according to an embodiment of the present invention.

Referring to FIG. 3, a dust separating apparatus 100 of the present invention comprising a casing 110, a cyclone unit 120, a dust collection part 130, and a cover 140 is shown.

The casing 110 has a certain height and is substantially semicircular in cross section. In other words, the casing 110 is semicircular to correspond to the mounting chamber 13 (refer to FIG. 1) of the vacuum cleaner body 11, in which the dust separating apparatus 100 is mounted. The bottom surface of the casing 110 is connected with an inlet port 111 and an outlet port (not shown), the inlet port 111 is fluidly communicated with a suction nozzle (not shown) of the vacuum cleaner, and the outlet port (not shown) is fluidly communicated with the motor driving chamber 12 (refer to FIG. 1) of the vacuum cleaner 10.

Figure 4:
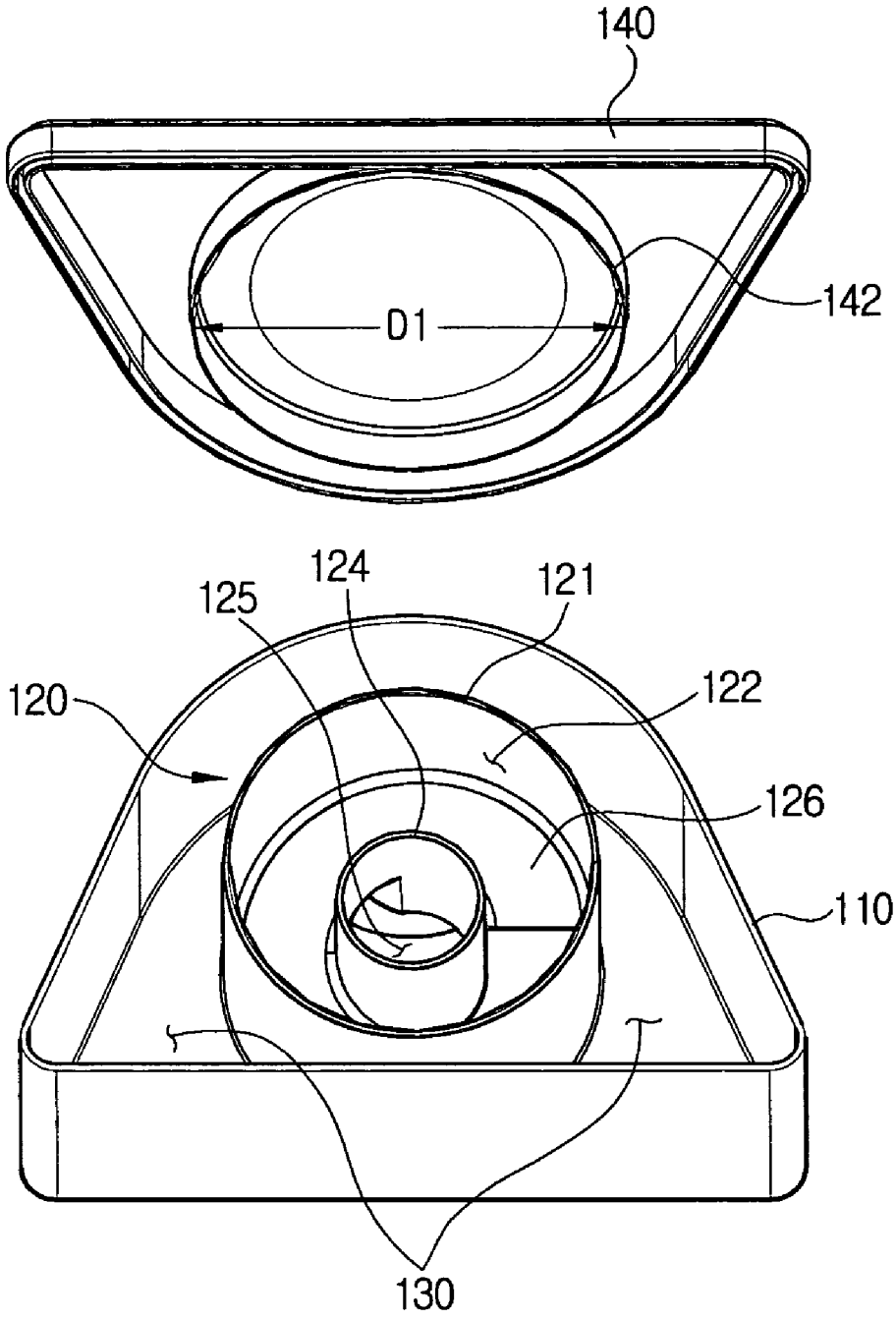
FIG. 4 is an exploded perspective view of a dust separating apparatus of FIG. 3.
Figure 5:
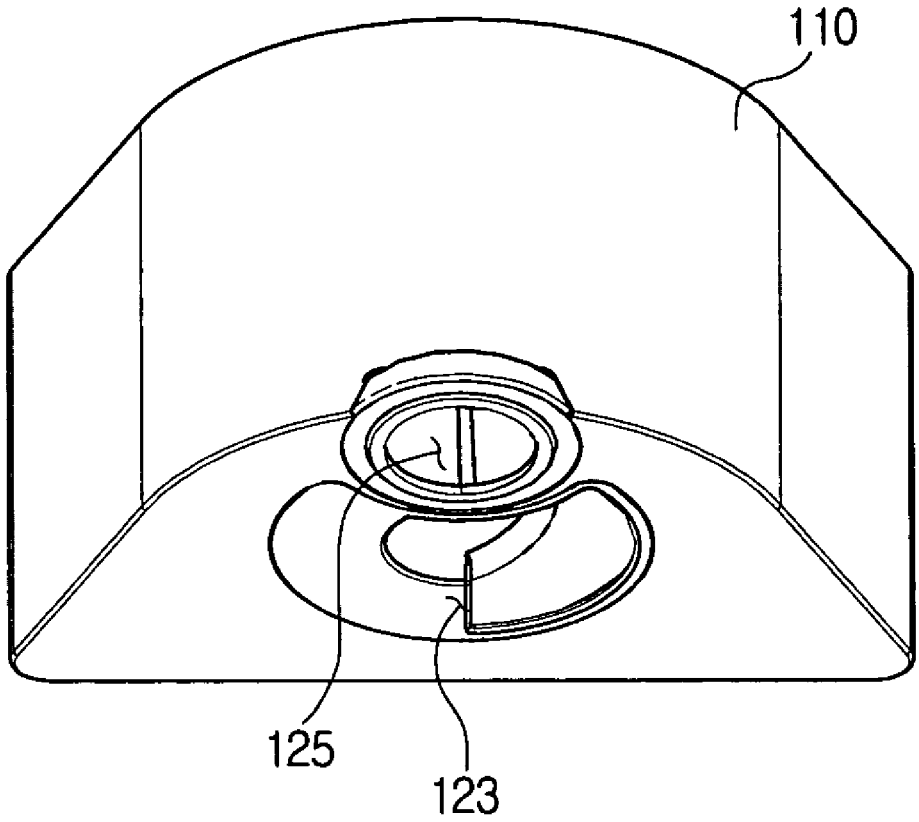
FIG. 5 is a bottom perspective view of a casing of the dust separating apparatus of FIG. 3.

Referring to FIGS. 4 and 5, the casing 110 has the cyclone unit 120 and the dust collection part 130 therein.

The cyclone unit 120 is formed in a substantial central portion of the casing 110 to separate the contaminants from air drawn in the cyclone unit 120 and discharge the air removed of contaminants to an air outlet 125. The cyclone unit 120 comprises a cyclone body 121 forming a cyclone chamber 122, an air inlet 123, and an air guide pipe 124 with the air outlet 125.

Figure 6:
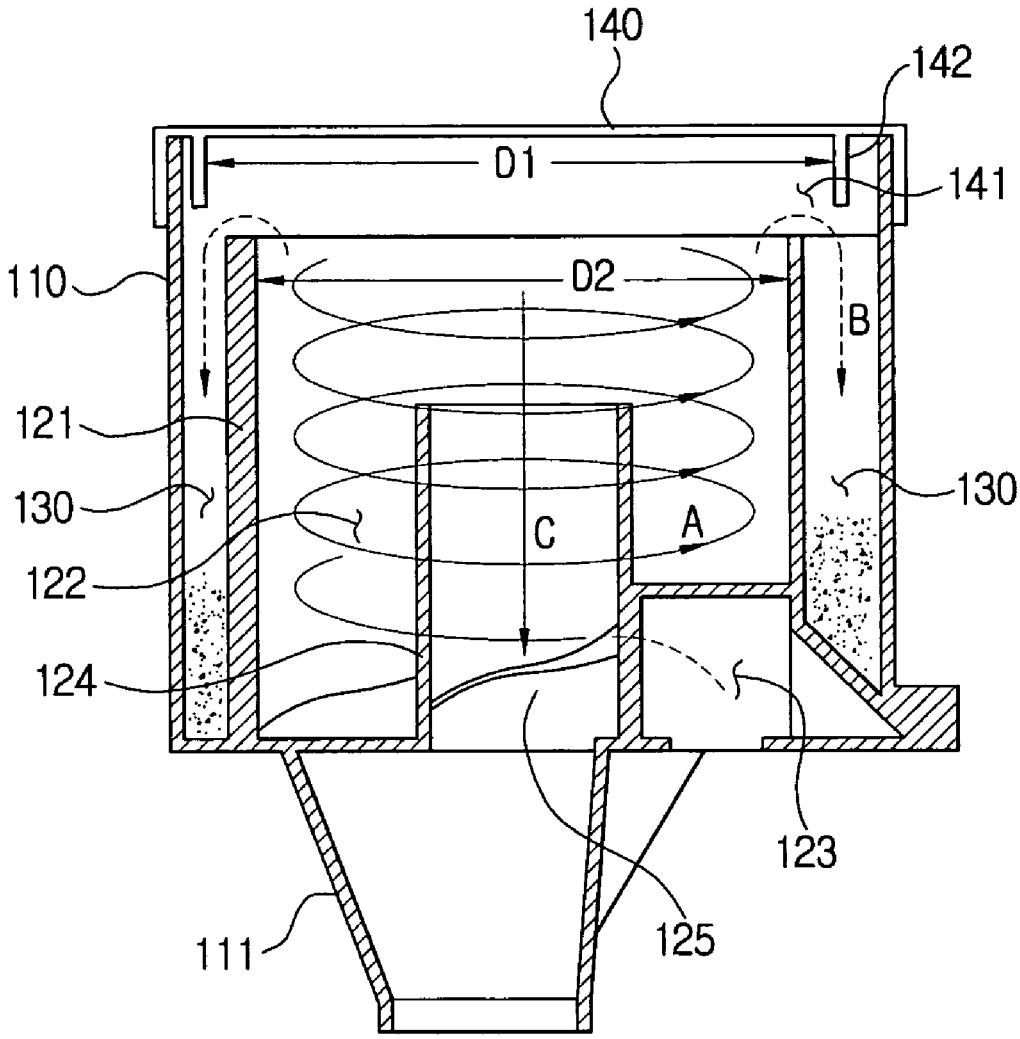
FIG. 6 is a cross-sectional view of the dust separating apparatus taken along lines VI-VI line of FIG. 3.

The cyclone body 121 is cylindrical, allowing air and contaminants to form a rotative stream, and is a little lower than the casing 110 (refer to FIG. 6). The air inlet 123 is formed on a bottom surface of the cyclone body 121 to fluidly communicate with the inlet port 111. As contaminant-laden air flows in via the inlet port 111, the air inlet 123 allows the air to flow into the cyclone body 121. A spiral-shaped guide member 126 of a predetermined length is configured on an inner wall of the cyclone body 121 to have a gradually higher height from the bottom, forcing the contaminant-laden air to form a rotative stream as it ascends up through the cyclone body 121.

The air guide pipe 124 is formed in a substantially central portion of the cyclone body 121, and protrudes a predetermined length from a bottom surface of the cyclone body 121. The air outlet 125 is formed at a bottom portion of the air guide pipe 124 to discharge the air removed of the contaminants by the cyclone chamber 122 to the outside.

As shown in FIG. 5, the air inlet 123 and the air outlet 125 are arranged in parallel on the bottom surface of the cyclone body 121. The air outlet 125 is fluidly communicated with the motor (not shown) of the vacuum cleaner 10. In other words, the dust separating apparatus 100 according to an embodiment of the present invention has a structure of suction and discharge through the bottom portion. A filter member (not shown) such as a grille may be formed at a top portion of the air guide pipe 124 to filter contaminants from the drawn-in air.

The dust collection part 130 collects contaminants separated from the drawn-in air by the cyclone unit 120. The dust collection part 130 is arranged in parallel with the cyclone unit 120, except for an area where the cyclone unit 120 is mounted in the casing 110. In other words, the dust collection part 130 is surrounded by an inner wall of the casing 110 and an outer wall of the cyclone body 121.

Figure 2:
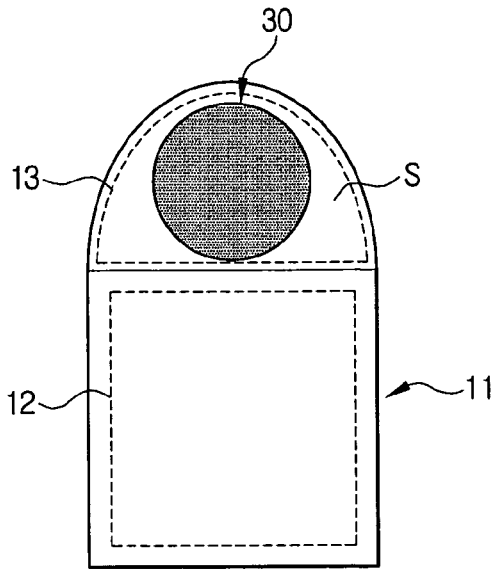
FIG. 2 (PRIOR ART)
FIG. 2 is a schematic plan view of the vacuum cleaner body of FIG. 1.

As described above, the casing 110 is semicircular to correspond to the mounting chamber 13 (refer to FIG. 1), in which the dust separating apparatus 100 is mounted, of the vacuum cleaner 10, and the cyclone unit 120 is arranged in parallel with the dust collection part 130 formed in a dead space surrounding the cyclone unit 120 in the casing 110, thus increasing the capacity of dust collection part 130. As shown in FIG. 1, the conventional dust separating apparatus 30 has the contaminant receptacle 32 under the cyclone body 31 so that the capacity of the contaminant receptacle 32 is limited. However, according to an embodiment of the present invention, the casing 110 is semicircular to remove the dead space S (refer to FIG. 2) from the dust collection chamber 13 of the vacuum cleaner body 11, in which the dust separating apparatus 100 is mounted, and to replace the dead space S with the dust collection part 130. Accordingly, the size of the vacuum cleaner body 11 is not changed, but the capacity of the dust collection part 130 is increased.

Referring back to FIG. 4, the cover 140 is detachably engaged with a top portion of the casing 110. Accordingly, to repair the casing 110 or to empty the contaminants collected in the dust collection part 130, all that is required is revomal of the cover 140. A dust discharge opening 141 is formed by the cover 140 and the top portion of the cyclone body 121. The cyclone body 121 is lower than the casing 110. Accordingly, as the cover 140 is engaged with the casing 110, the dust discharge opening 141 is formed between the inside of the cover 140 and the top portion of the cyclone body 121 (refer to FIG. 6). A counterflow prevention member 142 protrudes from the inside of the cover 140 by a certain length to prevent contaminant collected in the dust collection part 130 from flowing backward into the cyclone body 121. As shown in FIGS. 4 and 6, the diameter D1 of the counterflow prevention member 142 is larger than the diameter D2 of the cyclone body 121.

The operations and functions of the dust separating apparatus 100 with the above structure according to an embodiment of the present invention will be explained with reference to FIG. 6.

The motor (not shown) of the vacuum cleaner generates a suction force which operates via the dust separating apparatus 100 on the air inlet 123. Air and contaminant are drawn through the suction nozzle (not shown), which is fluidly communicated with the air inlet 123 and an inlet port 111, and the air inlet 123 into the cyclone body 121.

As contaminant-laden air flows into the air inlet 123, the contaminant-laden air forms a rotative stream, ascending through the cyclone chamber 122 as illustrated by arrow A. At this time, heavier-than-air contaminants are gathered on the inner wall of the cyclone body 121 by centrifugal force. The contaminants flow upward by means of the rotative stream, flow out through the dust discharge opening 141, and collect on a bottom surface of the dust collection part 130 as illustrated by arrow B. The contaminant collected in the dust collection part 130 can not flow backward in the cyclone chamber 122 because of the counterflow prevention member 142.

The air removed of the contaminants collides with the cover 140, causing the air removed of the contaminants to descend back through cyclone chamber 122 into the air guide pipe 124, and to discharge via the air outlet 125 to the outside of the casing 110 as illustrated by arrow C.

The foregoing embodiments and advantages are merely exemplary and are not to be construed as limiting the present invention. The present invention can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A vacuum cleaner comprising:

a body;

a mounting chamber in the body;

a dust separating apparatus comprising a casing, a cyclone unit, and a dust collection part, the dust separating apparatus being detachably engaged with the mounting chamber in the body so that a dead space between the cyclone unit and the mounting chamber is utilized by the dust collection part, wherein the cyclone unit comprises a cylindrical cyclone body forming a cyclone chamber and having a height lower than the casing. and an air inlet and an air outlet which are formed on a bottom surface of the cyclone body.

2. The vacuum cleaner according to claim 1, wherein the dust collection part surrounds the cyclone unit.

3. The vacuum cleaner according to claim 1, wherein the mounting chamber and the dust collection part are both substantially semicircular.

4. The vacuum cleaner according to claim 1, wherein the dust separating apparatus further comprises a cover being detachably engaged with the casing.

5. The vacuum cleaner according to claim 4, further comprising a counterflow prevention member protruding a predetermined distance from an inside portion of the cover.

* * * * *